US006480177B2

(12) United States Patent
Doherty et al.

(10) Patent No.: US 6,480,177 B2
(45) **Date of Patent: *Nov. 12, 2002**

(54) BLOCKED STEPPED ADDRESS VOLTAGE FOR MICROMECHANICAL DEVICES

(75) Inventors: Donald B. Doherty, Richardson; Henry Chu, Plano; James D. Huffman, Richardson, all of TX (US)

(73) Assignee: Texas Instruments Incorporated, Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/088,673

(22) Filed: Jun. 2, 1998

(65) Prior Publication Data

US 2001/0011978 A1 Aug. 9, 2001

(51) Int. Cl.[7] ..... G09G 3/34

(52) U.S. Cl. ..... 345/84; 345/55; 345/85; 345/100; 345/108; 345/204; 348/750; 348/770

(58) Field of Search ..... 345/51, 84, 85, 345/87, 90, 94, 103, 100; 348/750, 770

(56) References Cited

U.S. PATENT DOCUMENTS 5,285,407 A 2/1994 Gale et al.
5,548,301 A * 8/1996 Kornher et al. ..... 345/85
5,581,272 A * 12/1996 Conner et al. ..... 345/85
5,612,713 A * 3/1997 Bhuva et al. ..... 345/84
5,657,036 A * 8/1997 Markandey et al. ..... 345/85
5,673,060 A * 9/1997 Blaxtan et al. ..... 345/84
5,686,939 A * 11/1997 Millward et al. ..... 345/148
5,745,193 A * 4/1998 Urbanus et al. ..... 348/771
6,008,785 A * 12/1999 Hewlett et al. ..... 345/85
6,034,660 A * 3/2000 Millward et al. ..... 345/84
6,057,816 A * 5/2000 Eckersley ..... 345/85

* cited by examiner

*Primary Examiner*—Richard Hjerpe
*Assistant Examiner*—Henry N. Tran
(74) *Attorney, Agent, or Firm*—Charles A. Brill; Wade James Brady, III; Frederick J. Telecky, Jr.

(57) ABSTRACT

A method of addressing an array of spatial light modulator elements. The method divides the array into blocks of elements, provides reset lines (MRST) to each of the block of elements, separate from the other blocks of elements, as well as address voltage supplies ($VCC_{ADDR}$) to each of the block of elements, separate from the other blocks of elements, addresses data to each of the blocks independent of the other blocks, resets each of the blocks, and steps address voltage to each of the block, where only blocks that are being reset receive the stepped address voltage. A spatial light modulator array (32) is also provided that has a layout to facilitate the method, including internal or external circuitry (34) to provide control of the stepped addressing voltages.

17 Claims, 3 Drawing Sheets

BLOCKED STEPPED ADDRESS VOLTAGE FOR MICROMECHANICAL DEVICES

BACKGROUND OF THE INVENTION

1. Field of the Invention

This invention relates to display systems using spatial light modulators, and more particularly to the organization of display elements on the SLM and to methods of addressing the display elements with data.

2. Background of the Invention

Display systems based on spatial light modulators (SLMs) are increasingly used as alternatives to display systems using cathode ray tubes (CRTs). SLM systems provide high resolution displays without the bulk and power consumption of CRT systems.

SLMs take many forms, but one particular type is the array SLM. The array typically comprises an x-y grid of individually addressable elements, which correspond to the pixels of the image that they generate. Generally, pixel data is displayed by loading memory cells connected to the elements. The elements maintain their on or off state for controlled display times. The array of display elements may emit or reflect light simultaneously, such that a complete image is generated by addressing display elements. Examples of SLMs are liquid crystal displays (LCDs), digital micromirror devices (DMDs) and actuated mirror arrays (AMAs), both which have arrays of individually driven display elements.

Pulse-width modulation (PWM) techniques allow the system to achieve intermediate levels of illumination, between white (on) and black (off). The basic PWM scheme involves determining the rate at which images are to be presented to the viewer. This establishes a frame rate and a corresponding frame period.

Then, the intensity resolution for each pixel is established. In a simple example that assumes n bits of resolution, the frame time is divided into $2^n-1$ equal time slices. For a 33.3 millisecond frame period and n-bit intensity values, the time slice is $33.3/(2^n-1)$ milliseconds. Pixel intensities are quantized, such that black is 0 time slices, the intensity level represented by the LSB is 1 time slice, and maximum brightness is $2^n-1$ time slices. Each pixel's quantized intensity determines its on-time during a frame period. The viewer's eye integrates the pixel brightness making the image appear the same as one generated with analog levels of light.

For addressing SLMs, use of PWM results in the data being formatted into "bit-planes," each bit-plane corresponding to a bit weight of the intensity value. If each pixel's intensity is represented by an n-bit value, each frame of data has n bit-planes. The bit-plane representing the LSB of each pixel is displayed for 1 time slice, whereas the bit-plane representing the MSB is displayed for $2^n/2$ time slices. A time slice is only $33.3/(2^n-1)$.milliseconds, so the SLM must be capable of loading the LSB bit-plane within that time. The time for loading the LSB bit-plane is the "peak data rate." U.S. Pat. No. 5,278,652, entitled "DMD Architecture and Timing for Use in a Pulse-Width Modulated Display System," assigned to Texas Instruments Incorporated describes various methods of addressing a DMD in a DMD-based display system. These methods concern loading data at the peak data rate. In one method, the time for the most significant bit is broken into smaller segments so that loading for less significant bits can occur during these segments. Other methods involve clearing the display elements and using extra "off" times to load data.

Another approach is divided reset that involves dividing up the array of elements into reset blocks, which can be done far more easily than redesigning the entire control circuitry as in the split reset approach. Each reset block is reset to react to its new data independently, allowing the addressing circuitry underneath it to be handled in blocks, rather than as the entire array.

An embodiment of divided reset is phased reset, which involves resetting each block independently, "phasing" the data through the frame time, allowing more time for addressing and display for each block. This leads to better brightness and reduction of artifacts, since more time is used and the entire device is not reset at once. However, it can be extremely complicated when it interferes with the movement of the data to each element.

SUMMARY OF THE INVENTION

One aspect of the invention is a method of addressing a spatial light modulator. The modulator comprises an array of individually controllable elements. The array is divided up into blocks, each block having its own reset, which allows each block to operate independently of the other blocks within a frame time. Operating each independently allows the peak data rate to be reduced. In order to allow each block to be operated independently, the address voltage is divided up to be operated by block as well. In one embodiment of the invention, logic circuitry determines which blocks require stepped address voltage and the row address for applying the address voltage is decoded.

It is an advantage of the invention in that it allows use of all of the advantages of divided reset for artifact reduction and increased brightness while eliminating problems from that process.

It is a further advantage of the invention in that it provides full range of control of the elements of the array.

It is a further advantage of the invention in that it reduces wear on the device.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION OF THE'PREFERRED EMBODIMENTS

Spatial light modulators organized in x-y grids of individually controllable elements can be controlled through a series of row and column controllers. The controllers route the appropriate voltage signals to the appropriate addressing circuitry for each element. The element reacts by either allowing light to transmit to the display surface, the ON state, or not, the OFF state. Allowing light to transmit involves transmission through or reflection from the element, and the amount of time the element is in the ON state determines the brightness of the corresponding dot or pixel element (pixel) on the final image.

In some types of spatial light modulators, the addressing circuitry can receive data while the element is in the state dictated by a previously received data signal. A separate control line is activated with a signal that causes the element to respond to the new data at the appropriate time.

The timing of the new data depends upon the methods used to form the image. A common technique is pulse-width modulation (PWM), in which the brightness of the pixel is predetermined and programmed as a digital value have number of bits. For a binary representation of the pixel value, the most significant bit (MSB) of the data is given about one-half the frame time of the system for display, and the LSB is given $1/(2^n-1)$ of the frame time. For a 4-bit system, for example, the MSB gets 8/15 of the frame time, and the LSB 1/15 of the frame time.

The modulator must be loaded during this smallest time slice, the LSB time. The data rate during the LSB time is the peak data rate. Alternative representations of the pixel values can be implemented, but the data rate during the LSB time is always a critical system parameter.

Several approaches have been developed for reducing the peak data rate. Some of these approaches are discussed in U.S. Pat. No. 5,278,653, titled "DMD Architecture and Timing for Use in a Pulse-Width Modulated Display System," which is assigned to Texas Instruments and incorporated by reference. A second method, which is discussed in pending U.S. patent application Ser. No. 08/721,862, titled "Divided Reset for Addressing Spatial Light Modulator," assigned to Texas Instruments, divides the array into blocks of elements for reset.

Since pixels can be controlled for reset by block, they can be loaded and switched to their new data in blocks as well. This allows the individual block sequences to be reset as if they were smaller arrays, reducing the peak data rate and allowing better use of the time allocated to each bit. However, this approach can have problems conflicting with the addressing of the array. Signals that may be necessary for proper operation of the reset group come from the addressing circuitry and are typically global. Reset groups that do not need that signal receive those signals, which can upset some of the elements, causing undesirable artifacts in the image.

Figure 1:
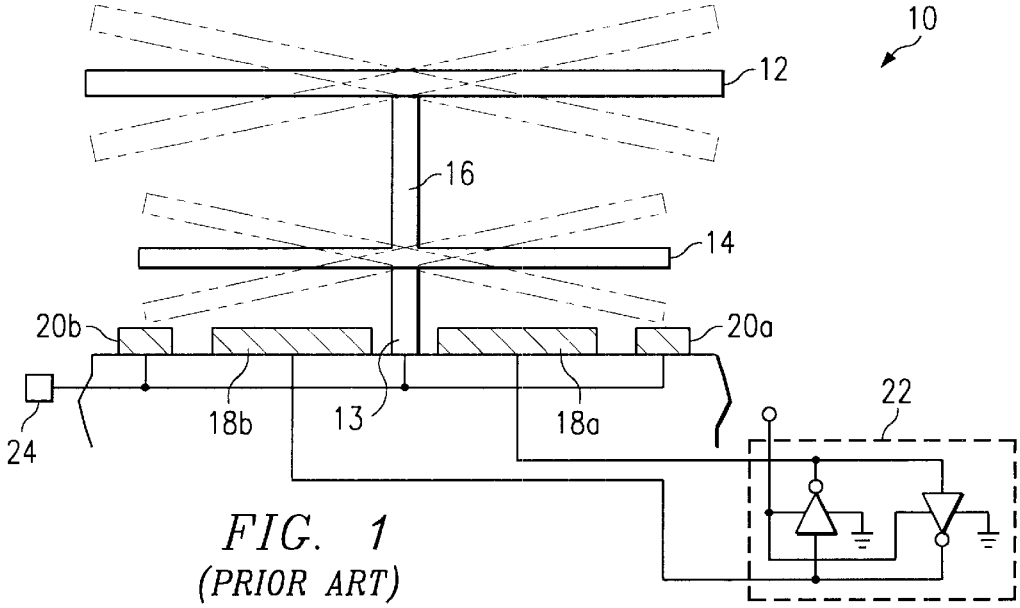
FIG. 1 (PRIOR ART)
FIG. 1 shows a prior art embodiment of a spatial light modulator array element with separate addressing and control lines.

For example, the digital micromirror device (DMD) manufactured by Texas Instruments, uses a stepped address reset process. An example of the DMD is shown in FIG. 1. The mirror 12 is suspended over the substrate by post 13, which is typically one of two posts. The device is seen from the side with the post facing. Opposite the post 13 would be another post, from which hangs suspended hinges, which in turn support the yolk 14. On yolk 14 is an upper post 16, which in turn supports the mirror 12. The yolk 14 is controlled by a series of electrodes underneath it. Address electrodes 18*a* and 18*b* are driven by addressing circuitry represented by the box 22. The electrode voltages switch between ground and $VCC_{ADDR}$. The circuitry in box 22 is intended as an example of circuitry which implements this switching, however, any circuitry that allows the two outputs to be complementary will do.

When either of the address electrodes receive the appropriate voltage signals from the addressing circuitry 22, electrostatic force builds up between the yolk 14 and the address electrodes, causing the yolk to be attracted to one of the electrodes. This causes the entire structure to tilt one way or the other, reflecting light towards or away from a display surface.

Landing electrodes 20*a* and 20*b* and the post 13 are connected together to provide bias voltage to the mirror. Holding the mirror at one bias helps in creating the voltage difference that allows the electrostatic attraction occur. It also affords an opportunity to manipulate voltages to assist in device stabilization and control. For example, when the yolk 14 touches down on one of the landing electrodes 20*a* or 20*b*, it can be latched into place with voltage, allowing the address electrodes to be loaded with data for the next state. The connection to the mirror then allows for reset pulses to cause the mirror to move to its next state.

The reset lines can be configured in several different ways. Global reset has all of the reset lines for all of the mirrors tied together, and all mirrors are reset at the same time to respond to their new data. However, as mentioned above, this increases the peak data rate, since the entire device must be loaded with its LSB data within one LSB time.

Figure 2:
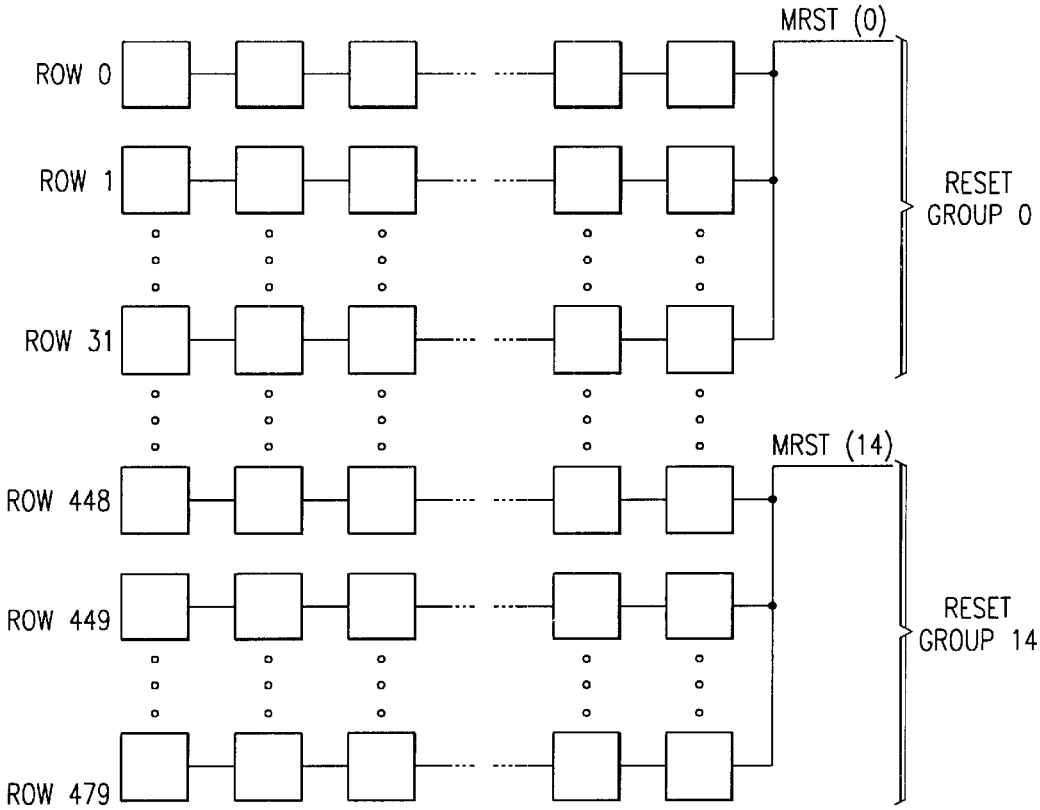
FIG. 2 (PRIOR ART)
FIG. 2 shows a prior art embodiment of a divided reset spatial light modulator array architecture.

A second alternative is the divided reset, as shown in FIG. 2. The array of elements are divided into reset blocks, typically groups of contiguous rows. In the example of FIG. 2, the device has 480 rows. Each reset group has 32 rows, and there are 15 groups. The reset signals MRST (0) through MRST (14) (Mirror ReSeT) are sent on lines that only connect to rows within the appropriate group.

An embodiment of the divided reset is phased reset, in which each reset group is reset independently and phased in time to achieve better efficiency and visual quality than global operation. To reset the groups independently, each group must have a separate bias/reset voltage that can be applied only to the mirrors in that group. However, this can conflict with addressing techniques.

To reset mirrors, in the example of the DMD, the stepped address reset process increases the address voltage for a short time in conjunction with the reset pulse. This increases the driving force by increasing the differential voltage to the mirrors. This stepped address voltage is typically applied during the transition of the elements from stationary to their new position. The address voltage does not come through the bias/reset line that is connected to that reset group, but to the entire device.

The application of this stepped address voltage to the entire device can upset some of the elements that are not in their reset cycle. There are several alternatives to this approach. First, the stepped address voltage could be reduced. Second, the bias voltage applied to the mirrors can be increased. However, reducing the stepped address voltage reduces the effectiveness of the reset, since the idea behind the stepped address voltage was to increase the driving force on the mirror. This overcomes wear problems such as hinge memory. Increasing the voltage bias increases the likelihood of the mirrors sticking to the landing electrodes. This decreases the useful life of the device because of surface damage to the electrode.

Figure 3:
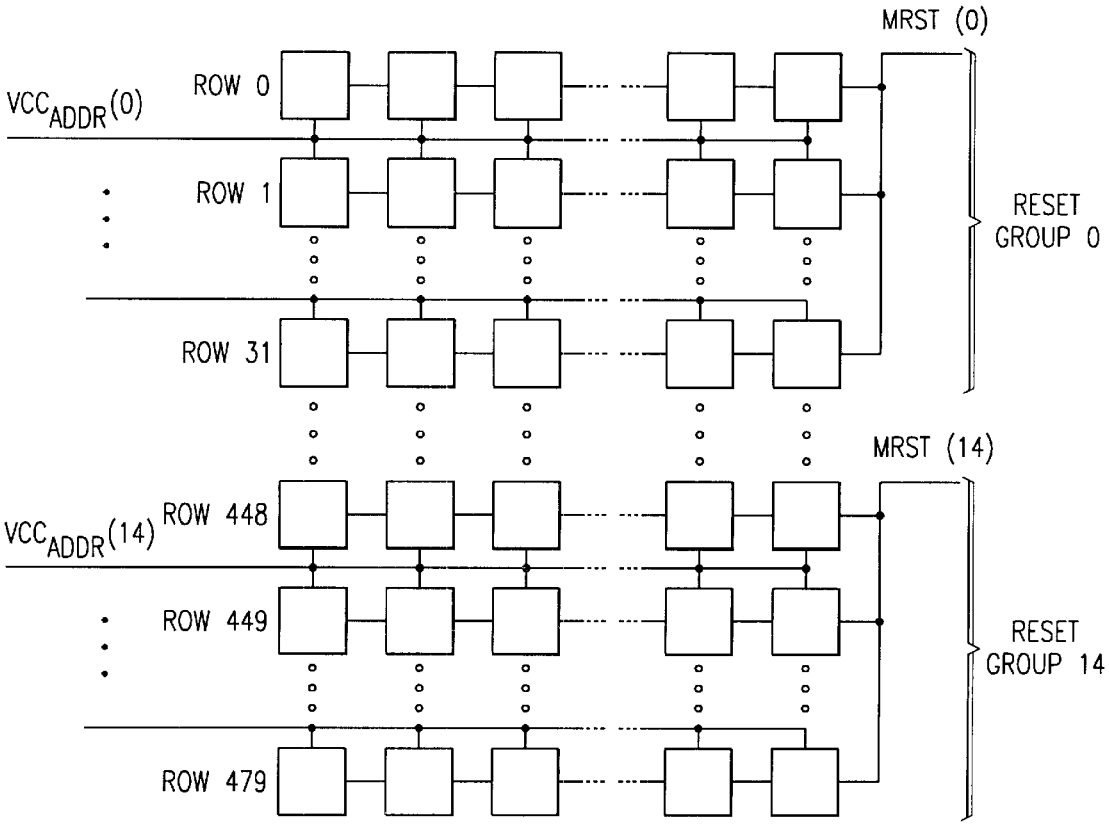
FIG. 3 shows one embodiment of a divided reset spatial light modulator array architecture with blocked addressing.
Figure 4A:
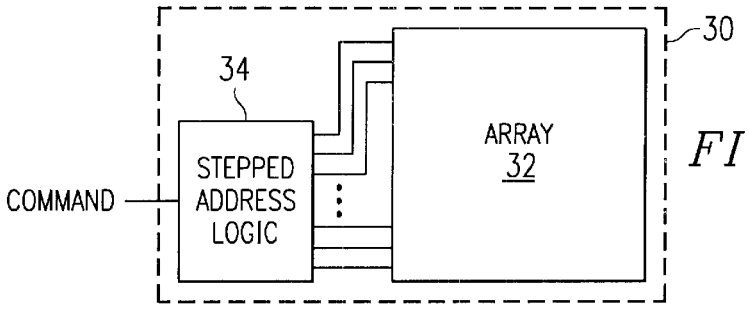
FIGS. 4*a–b* show embodiments of control circuitry for a divided reset spatial light modulator with blocked addressing.
Figure 4B:
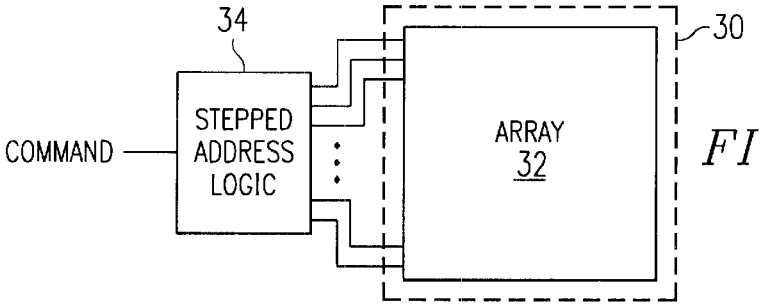
Figure 5:
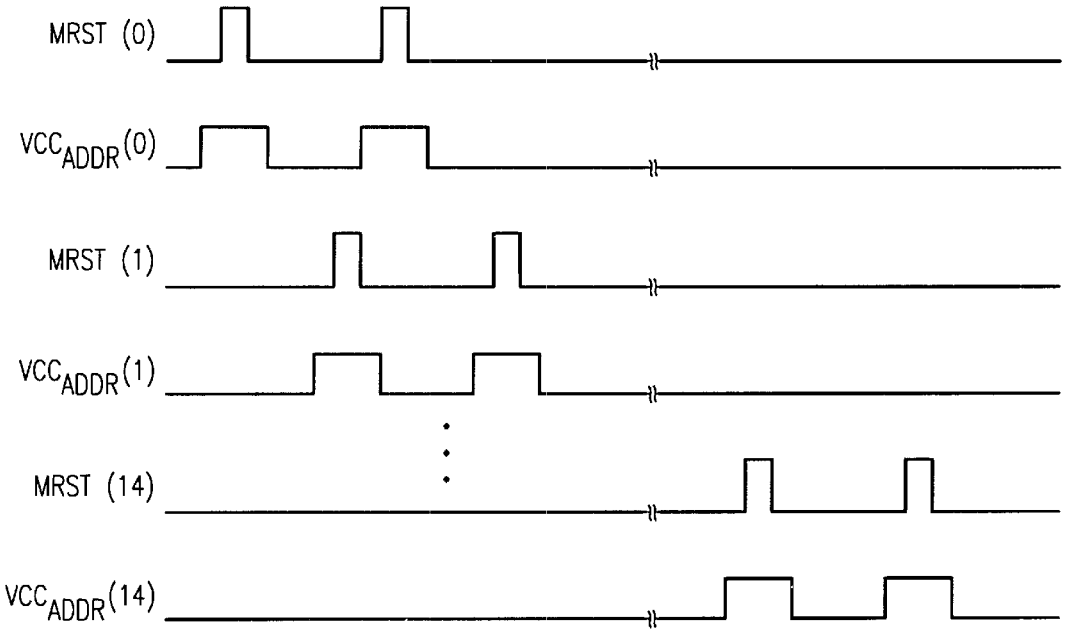
FIG. 5 shows a timing diagram for phased reset timing with blocked stepped addressing.

However, as shown in FIG. 3, a slight change to the device architecture could be made that allows each reset group to receive its addressing independently. The address voltage supply would be divided into the same blocks as the reset groups. Control of the address voltages is effected by externally shifting separate inputs to the reset groups, or adding internal circuitry to shift individual blocks between the reference voltage levels, as shown in FIGS. 4*a* and 4*b*. An example of blocked stepped address timing is shown in FIG. 5.

As shown in FIG. 3, the array architecture can be changed to implement specific row control for the stepped address in the memory latch. By using slightly smaller geometry processing and horizontally routing the stepped address voltages, specific row control can be implemented to access every two rows. This is shown in FIG. 3, where Row 0 and Row 1 receive address voltage from the same line, $VCC_{ADDR}$ 0. They do not receive the same data, the address supply voltage is just routed such that they can both receive it from the same line. One method for accomplishing this is to decode the row addresses for the stepped addressing, allowing those rows in a block to receive the step, but not any others. This eliminates any interference with the other blocks.

FIGS. 4*a* and 4*b* show the two alternatives for providing the shifting control for the voltage levels. The substrate of the modulator array 30 has both the array 32 and the shifting circuitry 34 on it in FIG. 4*a*. The COMMAND line sends the data and control signals and the circuitry 34 routes it to the appropriate reset group on the array 32. In FIG. 4*b*, the circuitry is external to the substrate 30, which has only the array 32 on it. In this case, the separate address voltage supplies are connected to the substrate 30.

It must be noted that only the high addresses get stepped. The object of the voltage stepping is to increase the voltage differential between an address 1 and an address 0. Therefore, only the high electrodes receive stepped voltage. With reference to FIG. 1, the address electrode to which the mirror is to be attracted is held at ground potential while the other receives the stepped voltage.

While the above example has been very specific to DMDs, it could also be used with other types of spatial light modulator arrays, or even other arrays of micromechanical devices that have the same concerns of addressing with data and controlling the individual moving parts. The address electrodes would be analogous to drive electronics on the micromechanical devices, and the reset signal would be the activating voltage for those devices. In regard to spatial light modulators, the address electrodes would typically have some means of addressing the elements, if not specifically by electrodes. The reset signals would be analogous to control voltages that cause the element to react to its data.

Thus, although there has been described to this point a particular embodiment for a method and structure for addressing an array of individually controlled elements, it is not intended that such specific references be considered as limitations upon the scope of this invention except in-so-far as set forth in the following claims.

What is claimed is:

1. A method of addressing an array of spatial light modulator elements, comprising the steps of:

dividing the array into blocks of elements;

providing reset lines to each of the blocks of elements, separate from the other blocks of elements;

providing address voltage supplies to each of the blocks of elements, separate from the other blocks of elements;

sending address data to each of the blocks independent of sending address data to the other blocks;

resetting each of the blocks to respond to the address data independent of the other blocks; and stepping address voltage to each of the blocks of elements, such that only the blocks of elements that are being reset receive the stepped address voltage.

2. The method of claim 1, wherein the array of elements further comprises an array of digital micromirrors.

3. The method of claim 1, wherein the address voltage supplies further comprise one address line to be shared by each pair of adjacent rows of the array.

4. The method of claim 1, wherein the step of stepping address voltage further comprises using logic to determine which blocks receive the stepped address voltage.

5. The method of claim 1 wherein the step of stepping address voltage further comprises stepping the address voltage only to those address electrodes receiving data corresponding to a one.

6. The method of claim 1, wherein the step of stepping address voltage includes decoding row addresses for row to which the stepped address voltage is to be applied.

7. A spatial light modulator comprising an array of individually addressable elements on one substrate divided into blocks, comprising:

reset lines for each block, such that each of the reset lines is independent of other reset lines;

address voltage supplies for each block, such that each of the address voltage supplies is independent of other address voltage supplies; and logic circuitry for determining which of the blocks is being reset and for stepping the address voltage supply for the blocks being reset.

8. The modulator of claim 7, wherein the address voltage supplies are laid out to have one address voltage line shared between each pair of adjacent rows of each block.

9. A method of addressing an array of spatial light modulator elements, comprising the steps of:

dividing the array into blocks of elements;

providing reset lines to each of the blocks of elements, separate from the other blocks of elements;

providing address voltage supplies to each of the blocks of elements, separate from the other blocks of elements, said address voltage supplies having an address voltage line shared by each pair of adjacent row of the array;

sending address data to each of the blocks independent of sending address data to the other blocks;

resetting each of the blocks to respond to the address data independent of the other blocks; and stepping an address voltage to each of the blocks of elements, such that only the blocks of elements that are being reset receive the stepped address voltage.

10. The method of claim 9, wherein the array of elements further comprises an array of digital micromirrors.

11. The method of claim 9, wherein the step of stepping address voltage further comprises using logic to determine which blocks receive the stepped address voltage.

12. The method of claim 9, wherein the step of stepping address voltage further comprises stepping the address voltage only to those address electrodes receiving data corresponding to a one.

13. The method of claim 9, wherein the step of stepping address voltage includes decoding row addresses for row to which the stepped address voltage is to be applied.

14. A spatial light modulator comprising an array of individually addressable elements on one substrate divided into blocks, comprising:

reset lines for each block, such that each of the reset lines is independent of other reset lines; and address voltage supplies for each block, such that each of the address voltage supplies is independent of other address voltage supplies, said address supplies having an address voltage line shared between each pair of adjacent rows of each block.

15. The modulator of claim 14, further comprising logic circuitry for determining which of the address voltage supplies should be stepped.

16. The modulator of claim 15, wherein the logic circuitry is on the substrate with the array.

17. The modulator of claim 15, wherein the logic circuitry is separate from the substrate.

* * * * *

UNITED STATES PATENT AND TRADEMARK OFFICE

CERTIFICATE OF CORRECTION

PATENT NO. : 6,480,177 B2 
DATED : November 12, 2002
INVENTOR(S) : Donald B. Doherty, Henry Chu and James D. Huffman It is certified that error appears in the above-identified patent and that said Letters Patent is hereby corrected as shown below:

Title page,
Insert Item:
-- [60] Related U.S. Application Data
Provisional Application No. 60/048,587 Jun. 4, 1997. --.

Signed and Sealed this

Twenty-seventh Day of December, 2005

JON W. DUDAS
*Director of the United States Patent and Trademark Office*